US009551166B2

(12) United States Patent
Patel et al.

(10) Patent No.: US 9,551,166 B2
(45) Date of Patent: Jan. 24, 2017

(54) ELECTRONIC INTERIOR DOOR RELEASE SYSTEM

(75) Inventors: Rajesh K. Patel, Farmington Hills, MI (US); Kosta Papanikolaou, Huntington Woods, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/287,362

(22) Filed: Nov. 2, 2011

(65) Prior Publication Data

US 2013/0104459 A1 May 2, 2013

(51) Int. Cl.

| | |
|---|---|
| ***E05B 85/12*** | (2014.01) |
| ***E05B 47/06*** | (2006.01) |
| ***E05B 77/54*** | (2014.01) |
| ***E05B 81/08*** | (2014.01) |
| *E05B 79/20* | (2014.01) |

(52) U.S. Cl.

CPC ..... *E05B 47/0657* (2013.01); *E05B 77/54* (2013.01); *E05B 81/08* (2013.01); *E05B 81/77* (2013.01); *E05B 85/12* (2013.01); *E05B 79/20* (2013.01); *Y10T 292/1082* (2015.04)

(58) Field of Classification Search

USPC ..... 49/502, 503; 292/201, 336.3, 259 A, 292/DIG. 4, DIG. 23, DIG. 67

See application file for complete search history.

(56) References Cited

U.S. PATENT DOCUMENTS 2,229,909 A * 1/1941 Wread ..... E05B 65/0021 292/177
4,193,619 A * 3/1980 Jerila ..... 292/168
4,889,373 A * 12/1989 Ward et al. ..... 292/336.3
5,018,057 A * 5/1991 Biggs ..... A45C 15/06 362/156
5,056,343 A 10/1991 Kleefeldt et al.
5,058,258 A 10/1991 Harvey
5,332,273 A * 7/1994 Komachi ..... E05B 81/25 292/336.3
5,334,969 A * 8/1994 Abe ..... B60R 25/1009 180/123
5,494,322 A * 2/1996 Menke ..... E05B 77/26 292/201
5,852,944 A * 12/1998 Collard, Jr. ..... E05B 47/0002 292/144
6,027,148 A * 2/2000 Shoemaker ..... E05B 47/0002 292/201

(Continued)

FOREIGN PATENT DOCUMENTS

DE 19620059 A1 11/1997
DE 102005041551 A1 3/2007

OTHER PUBLICATIONS

General Motors Corporation, 2006 Chevrolet Corvette Owner Manual, © 2005 General Motors Corporation, 4 pages.

(Continued)

*Primary Examiner* — Katherine Mitchell
*Assistant Examiner* — Shiref Mekhaeil
(74) *Attorney, Agent, or Firm* — Jason C. Rogers; Price Heneveld LLP

(57) ABSTRACT

A powered door latch may be actuated by a capacitive sensor or by movement of a mechanical release device. A controller may be utilized to prevent unlatching of the powered latch unless the vehicle is in Park and/or certain operating conditions are present.

5 Claims, 5 Drawing Sheets

(56) References Cited

U.S. PATENT DOCUMENTS 6,089,626 A * 7/2000 Shoemaker ..... E05B 47/0002 292/201
6,099,048 A * 8/2000 Salmon ..... E05B 77/52 292/201
6,256,932 B1 * 7/2001 Jyawook ..... E05B 77/24 292/336.3
6,441,512 B1 8/2002 Jakel et al.
6,460,905 B2 * 10/2002 Suss ..... 292/336.3
6,715,806 B2 * 4/2004 Arlt ..... E05B 81/06 292/201
6,779,372 B2 * 8/2004 Arlt ..... E05B 81/14 292/DIG. 23
6,786,070 B1 * 9/2004 Dimig ..... E05B 77/30 292/201
6,825,752 B2 * 11/2004 Nahata ..... E05B 81/78 180/273
6,843,085 B2 * 1/2005 Dimig ..... 70/237
7,062,945 B2 * 6/2006 Saitoh ..... B60R 25/246 49/460
7,070,018 B2 * 7/2006 Kachouh ..... E05B 81/14 180/287
7,090,285 B2 * 8/2006 Markevich ..... B60N 2/466 292/216
7,161,152 B2 * 1/2007 DiPoala ..... G08B 13/191 250/338.3
7,204,530 B2 * 4/2007 Lee ..... 292/336.3
7,205,777 B2 * 4/2007 Schulz ..... E05B 81/78 307/10.1
7,248,955 B2 * 7/2007 Hein ..... B60K 37/06 200/314
7,270,029 B1 9/2007 Papanikolaou et al.
7,360,803 B2 * 4/2008 Parent ..... E05B 81/14 292/117
7,363,788 B2 * 4/2008 Dimig ..... E05B 77/30 292/201
7,642,669 B2 * 1/2010 Spurr ..... E05B 81/76 200/43.05
7,705,722 B2 * 4/2010 Shoemaker ..... B60H 1/249 296/147
7,791,218 B2 9/2010 Mekky et al.
7,926,385 B2 4/2011 Papanikolaou et al.
8,141,296 B2 * 3/2012 Bem ..... E05B 47/02 340/686.6
8,405,515 B2 * 3/2013 Ishihara ..... B60R 25/246 340/10.1
8,616,595 B2 * 12/2013 Wellborn et al. ..... 292/336.3
2003/0025337 A1 * 2/2003 Suzuki ..... E05B 81/20 292/195
2003/0111863 A1 * 6/2003 Weyerstall ..... E05B 79/20 296/146.1
2003/0172695 A1 * 9/2003 Buschmann ..... 70/361
2005/0068712 A1 * 3/2005 Schulz et al. ..... 361/287
2008/0021619 A1 1/2008 Steegmann et al.
2008/0129446 A1 * 6/2008 Vader ..... 340/5.6
2008/0211623 A1 * 9/2008 Scheurich ..... G06F 21/32 340/5.2
2008/0224482 A1 9/2008 Cumbo et al.
2008/0230006 A1 * 9/2008 Kirchoff ..... B29D 11/00865 118/695
2008/0303291 A1 * 12/2008 Spurr ..... E05B 81/14 292/216
2009/0033477 A1 * 2/2009 Illium et al. ..... 340/436
2009/0160211 A1 * 6/2009 Krishnan ..... B60J 5/04 296/146.4
2009/0240400 A1 * 9/2009 Lachapelle ..... B60R 25/04 701/45
2010/0007463 A1 * 1/2010 Dingman ..... B60Q 1/2669 340/5.72
2010/0235057 A1 9/2010 Papanikolaou et al.
2010/0235058 A1 9/2010 Papanikolaou et al.
2010/0235059 A1 * 9/2010 Krishnan ..... E05B 81/14 701/49
2010/0265034 A1 * 10/2010 Cap et al. ..... 340/5.71
2011/0041409 A1 * 2/2011 Newman ..... H03K 17/955 49/324
2011/0180350 A1 * 7/2011 Thacker ..... E04G 7/307 182/186.8
2012/0119524 A1 * 5/2012 Bingle ..... E05B 81/28 292/336.3
2012/0154292 A1 * 6/2012 Zhao ..... G06F 1/1626 345/173
2012/0228886 A1 * 9/2012 Muller ..... E05B 85/107 292/336.3
2012/0252402 A1 * 10/2012 Jung ..... H04M 1/72569 455/405
2013/0321065 A1 * 12/2013 Salter et al. ..... 327/517
2014/0007404 A1 * 1/2014 Krishnan et al. ..... 29/428

OTHER PUBLICATIONS

General Motors LLC, 2013 Chevrolet Corvette Owner Manual, 2012, 17 pages.
General Motors, "Getting to Know Your 2014 Corvette," Quick Reference Guide, 2013, 16 pages.
InterRegs Ltd., Federal Motor Vehicle Safety Standard, "Door Locks and Door Retention Components," 2012, 23 pages, F.R. vol. 36 No. 232-02.12.1971.
Ross Downing, "How to Enter & Exit a Corvette With a Dead Battery," YouTube video http://www.youtube.com/watch?v=DLDqmGQU6LO, Jun. 6, 2011, 1 page.
Jeff Glucker, "Friends videotape man 'trapped' inside C6 Corette with dead battery," YouTube via Corvett Online video http://www.autoblog.com/2011/05/14/friends-videotape-man-trapped-inside-c6-corvette-with-dead-bat/, May 14, 2011, 1 page.
Don Roy, "ZR1 Owner Calls 911 After Locking Self in Car," website http://www.corvetteonline.com/news/zr1-owner-calls-911-after-locking-self-in-car/, Apr. 13, 2011, 2 pages.
Zach Bowman, "Corvette with dead battery traps would-be thief," website http://www.autoblog.com/2011/10/25/corvette-with-dead-battery-traps-would-be-thief/, Oct. 25, 2011, 2 pages.

* cited by examiner

ELECTRONIC INTERIOR DOOR RELEASE SYSTEM

FIELD OF THE INVENTION

The present invention generally relates to a powered latch for vehicles.

BACKGROUND OF THE INVENTION

Various powered latches with interior door releases for motor vehicles and the like have been developed. However, the powered latch may not operate properly if vehicle power is lost, and mechanical back up release arrangements have been developed to provide for unlatching of the vehicle door in the event the vehicle's main power supply is lost. However, known systems suffer from various drawbacks.

SUMMARY OF THE INVENTION

One aspect of the present invention is a vehicle door assembly including a powered latch release device. The door assembly includes a vehicle door having inner and outer opposite sides and a first side edge portion configured to be movably mounted to a vehicle. A second side edge of the door extends along an opposite edge of the vehicle door. The door assembly further includes a latch having a movable latch member and a powered actuator. The latch is mounted to the door adjacent the second side edge portion. A release member is movably mounted to the inner side of the vehicle door, and a mechanical member operably interconnects the release member to the movable latch member. Movement of the release member causes the movable latch member to move from a latched position to an unlatched position. The door further includes a capacitive or proximity sensor positioned adjacent the release member. The capacitive sensor is configured to detect an object moved to within a predefined vicinity or activation distance of the sensor. The powered actuator is operably connected to the movable latch member and shifts the latch member from a retaining position to a released position if the proximity sensor determines that an object is within the predefined vicinity. The activation distance may be optimized or tuned to provide either non-contact based activation or contact based activation.

The vehicle door assembly may be connected to a main vehicle electrical supply, and the powered actuator and proximity sensor may be operably connected to a programmable controller. The controller may be configured to release the latch only if an object is detected within the predefined vicinity twice within a predefined time interval. The programmable controller may also be configured to utilize vehicle operating parameters to control actuation of the powered actuator and unlatching of the powered latch device. For example, the controller may be operably connected to a sensor that determines when the vehicle transmission is in the Park position or state, and the controller may be configured to release the powered latch only if the vehicle transmission is in Park.

DETAILED DESCRIPTION OF THE PREFERRED EMBODIMENTS

Figure 1:
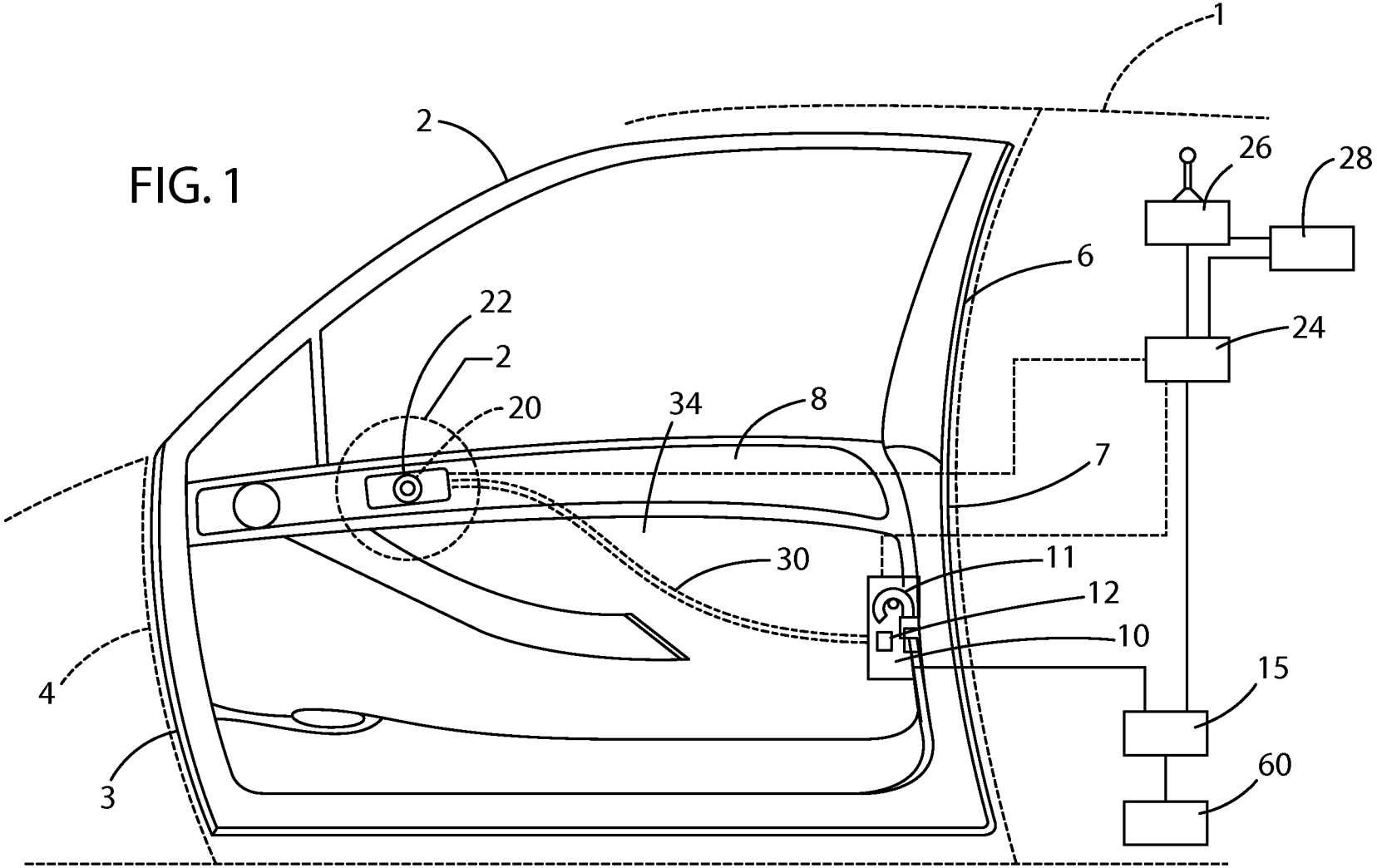
FIG. 1 is a side elevational view of a vehicle door including a powered latch and interior door released system according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a vehicle 1 includes a door assembly 2 that is movably mounted to a vehicle structure 4 along first edge 3 of door 2. In the illustrated example, the door 2 is pivotally mounted to the vehicle structure 4. The door assembly 2 includes a second side edge portion 6 extending along an opposite edge 7 of the door 2. The door assembly 2 also includes a powered latch device 10 that selectively latches the door to retain it in a closed position. The powered latch device 10 may comprise a powered latch as disclosed in U.S. Pat. No. 8,746,755 entitled "Universal Global Latch System" (U.S. Patent Publication No. 2010/0235057), and/or U.S. Pat. No. 8,544,901 entitled "Universal Global Latch System" (U.S. Patent Publication No. 2010/0235059), and/or the side door latch of U.S. Pat. No. 8,573,657 entitled "Latch Mechanism" (U.S. Patent Publication No. 2010/0235058), the entire contents of each of these applications being incorporated herein by reference.

As described in more detail in these patent applications, powered latch device 10 includes a movable latch member 11 and a powered actuator 12. The powered latch device 10 is mounted to the door 2 adjacent the second side edge portion 6. A release member 20 is movably mounted to the inner side 8 of the vehicle door 2. The release member 20 may include a capacitive sensor 22 mounted therein. The capacitive sensor 22 detects the presence of an object such as a users' hand that is within a predefined distance of the capacitive sensor 22. The powered latch device 10 and capacitive sensor 22 may be operably connected to a main vehicle power supply 15. The powered latch device 10 and sensor 22 may also be operably connected to a controller 24 that may be programmed to control operation of the powered latch 10. Controller 24 may also be operably connected to a gear shift selector mechanism 26 and/or a vehicle transmission 28. The gear shift selector 26 may comprise a conventional shift selection lever for automatic transmissions, and may define Park, Reverse, Neutral, Drive, and/or other control positions that provide operator input with respect to control of transmission 28. Gear shift selector 26 may also comprise a manual shift lever or other operator input device.

A mechanical member such as a mechanical cable 30 extends through an interior space 34 of door 2, and mechanically interconnects release member 20 to the powered latch device 10. Cable 30 may include an outer sheath 31 and an inner flexible cable member 32 (FIG. 3).

Figure 2:
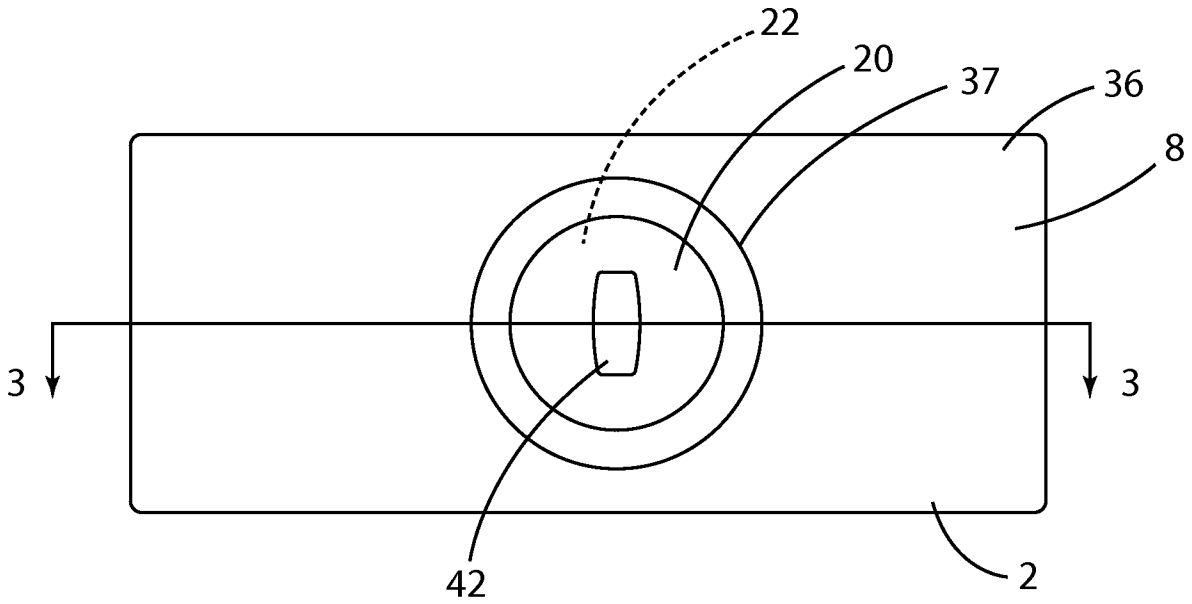
FIG. 2 is an enlarged view of a portion of the door of FIG. 1.
Figure 3:
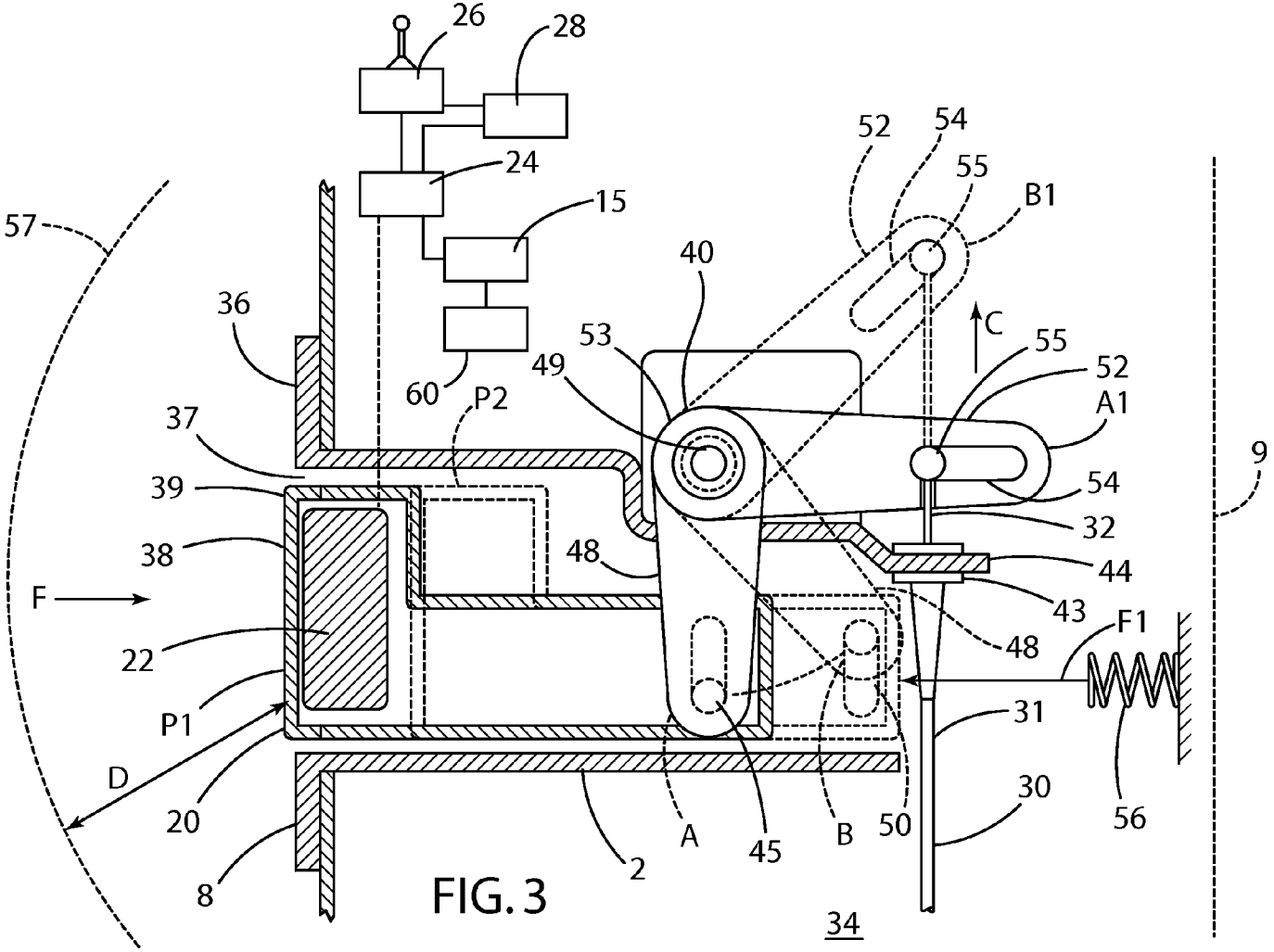
FIG. 3 is a cross-sectional view of a portion of the door taken along the line 3-3 of FIG. 2.

With further reference to FIGS. 2 and 3, release member 20 may be movably connected to a housing or bezel 36 having an opening 37 that receives movable member 20. In the illustrated example, release member 20 has a flat outer surface 38 and a circular peripheral edge 39. However, it will be understood that the release member 20 may comprise a variety of shapes, depending upon the particular vehicle or application. Release member 20 may include a design or other indicia 42 representing the vehicle make and/or providing a decorative appearance. Also, movable member 20 may comprise a button or the like that moves linearly as shown in FIG. 3, or it may comprise a lever or other such movable member.

Referring again to FIG. 3, mechanical cable 30 is mounted to inner vehicle door structure 44 utilizing a conventional fitting 43 or the like. A bellcrank 40 includes a center section 53, a first arm 48, and a second arm 52. Bellcrank 40 is rotatable mounted to a pin 49. First arm 48 includes a pin or boss 45 that is received in an elongated slot 50 of release member 20. Second arm 52 includes an elongated slot 54 that receives an end fitting 55 that is connected to an end of flexible inner cable 32. End fitting 55 may be configured to operably engage a linear guide (not shown) that constrains movement of fitting 55 such that I travels along a linear path.

If a sufficiently large force "F" is applied to release member 20 by a user, release member 20 moves from the position "P1" to an inner position "P2." As the release member 20 moves from position P1 to position P2, pin 45 moves upwardly in slot 50 of release member 20, thereby rotating first arm 48 from position "A" to position "B." As arm 48 rotates, second arm 52 rotates from position "A1" to position "B1." As arm 52 rotates, an end fitting 55 of flexible inner cable 32 moves in slot 54 of arm 52 thereby pulling shifting flexible inner cable 32 in a linear manner in the direction "C." A spring 56 (FIG. 3) provides a biasing force F1 tending to prevent movement of release member 20 from position P1 to position P2, and causing movement of release member 20 from position P2 back to position P1 when a force F is no longer applied to release member 20.

Referring again to FIG. 1, cable 30 operably interconnects release member 20 and powered latch device 10. Powered latch device 10 is configured such that movement of inner cable 32 causes movable latch member 11 to shift from a latched position to an unlatched position. As discussed in more detail in previously identified U.S. Pat. Nos. 8,746,755; 8,544,901; and 8,573,657, powered latch 10 may be configured such that a first push on release member 20 by a user shifts or changes the powered latch device from a locked position/state ("locked") to an unlocked position/state ("unlocked state"), but does not shift movable latch member 11 from a latched position to an unlatched position. Powered latch device 10 may be configured to shift movable latch member 11 from a latched position to an unlatched position if release member 20 is pushed twice. In this example, a first movement of release member 20 causes powered latch device 10 to shift from a "double locked" state to a "single locked" state, and a second movement of release member 20 causes the powered latch device 10 to change from the "single locked" state to an unlatched state. When in the unlatched state, powered latch device 10 actuates solenoid 12, and solenoid 12 shifts latch member 11 from a latched position to an unlatched position. Thus, powered latch device 10 and release member 20 can be configured to provide unlatching based on two separate movements of member 20 in a manner that is similar to the two pulls that are required to unlock and unlatch a door having a conventional mechanical door handle and lock/latch.

Movable release member 20 may include a capacitive or proximity sensor 22 (FIG. 3) that is operably connected with controller 24. Sensor 22 may be configured to generate a signal if an object such as a user's hand has come within a predefined distance "D" (dashed line 57) of sensor 22. Sensor 22 may be configured to provide a signal if an object comes closer than the predefined distance D, sending a signal to controller 24 if this occurs. Alternately, sensor 22 may be configured to provide a variable signal to controller 24 corresponding to a variable distance of an object from sensor 22, and controller 24 may be configured to determine if the object is closer than a predefined distance D based on the variable signal.

Controller 24 may be configured to release latch 10 if an object closer than the predefined distance "D" is detected twice within a predefined time. For example, the predefined distance D could be in the range of about 0 to 6 inches. It will be understood that the magnitude of the predefined distance D may be set for the requirements of a particular application. Specifically, the same release member 20 may be utilized in different vehicle types or models, and the distance D can be set as required for each type of vehicle. Also, the time interval between detection of an object within distance D may also be set for a particular application. For example, the time interval may be in the range of 0 seconds to about 5 seconds, 0 seconds to about 2 seconds, or other suitable time interval. Latch device 10 may have three different "states" or conditions corresponding to states or conditions of conventional mechanical door handles, latches, and locks. Specifically, latch device 10 may include a start or first ("locked") state, an "unlocked" or second state, and an "unlatched" or third state. Latch device 10 may be configured to reset to the first state (locked and latched) automatically such that the first state is the default state. If latch device 10 is in the default/first state and it receives a signal indicating that an object is closer than the predefined distance D, latch device 10 shifts from the first state to the second "unlocked" state. If an object is not detected within distance D within a predefined time interval, latch device 10 resets to the first state. However, if two discreet occurrences of an object being within distance D occur within the predefined time interval, latch device 10 changes from the first state to the second state, and then from the second state to the third state. Once the latch device 10 shifts to the third state, powered latch device 10 causes actuator 12 to unlatch movable latch member 11.

Controller 24 may be configured to provide a signal to powered latch device 10 under certain vehicle operating conditions. For example, controller 24 may be configured such that a signal allowing unlatching of latch device 10 is only generated if main power supply 15 is operational and gear shift selector 26 (and transmission 28) are in Park. In this way, inadvertent latch release while the vehicle is moving is prevented, even if an object is moved within the predefined distance D within the predefined time interval. Also, controller 24 may be operably connected to a vehicle speed indicator (not shown), whereby the powered latch is only unlatched if the vehicle speed is at or below a predefined level. Also, powered actuator 12 may be a solenoid that is powered only when the vehicle is parked to thereby prevent inadvertent release when the vehicle is in motion. Under power loss from main vehicle power supply 15 or low battery conditions, a backup power supply such as a battery 60 or capacitor (not shown) can be utilized to power the latch device 10, and release member 20 can be shifted mechanically to release the latch 11.

However, if power is being supplied by main power supply 15 at a normal or acceptable level, and if the vehicle is in motion (e.g. not in Park) mechanical activation of release member 20 will not release the movable latch member 11 due to the logic programmed into controller 24. As described in more detail in U.S. Pat. Nos. 8,746,755; 8,544,901; and 8,573,657, powered latch device 10 includes a mechanism that mechanically sets the latch device such that latch member 11 unlatches if release member 20 is pushed a second time. Also, powered latch device 10 may include a micro switch (not shown) or other suitable sensor that generates a signal to controller 24 upon movement of an internal latch member that is mechanically connected to inner cable member 32. In this way, controller 24 can determine if release member 20 has been shifted twice within a predefined time interval, and controller 24 can actuate the solenoid/powered actuator 12 upon a second push/movement of release member 20.

As discussed above, controller 24 may be configured to prevent shifting of movable latch member 11 to an unlatched position if the vehicle is moving. Specifically, controller 24 may be configured to continuously and automatically reset to the first state at very short time intervals unless the controller determines that the vehicle is Parked. Thus, if the vehicle is in motion and movable release member 20 is pushed twice within the predefined time interval, controller 24 prevents actuation of solenoid 12 by rapidly resetting to the first state before a user is able to push or release member 20 a second time. Thus, the movements of release member 20 when the vehicle is not in Park result in powered latch device 10 shifting from the first state to the second state, even if release member 20 is manually moved twice within the predefined time interval. This prevents shifting to the third state which would otherwise permit movement of movable latch member 11 to an unlatched position.

If powered latch device 10 is configured to continuously reset to the first state at a rapid rate unless the vehicle is in Park, detection of an object within predefined distance D by sensor 22 within a predefined time interval will also not result in shifting of movable latch member 11. More specifically, a first detection of an object within the predefined distance resets powered latch device 10 to the second state. However, powered latch device 10 rapidly resets (within a fraction of a second) to the first state unless the vehicle is in Park, such that detection of an object within the predefined distance D a second time will not cause powered latch device 10 to shift from the second state to the third state. In general, powered latch device 10 is configured to automatically reset from the second state to the first state if the vehicle is not in Park at a very rapid rate at very small time intervals that are much less than the predefined time interval between detected movements of release member 20 (or detections of an object by sensor 22) that would otherwise result in release of the powered latch 10. Also, it will be understood that powered latch device 10 and controller 24 may utilize additional vehicle operating parameters (other than the vehicle being in Park) to determine if powered latch device 10 should be unlatched.

It will be understood that the powered latch device 10 may be configured to require activation (i.e. "power on") of solenoid 12 to unlatch powered latch 10. Alternately, a spring or the like may be utilized to store energy and act in a direction that is opposite that of the solenoid to provide for actuation of the solenoid when the solenoid is changed from an energized state to a de-energized state. If configured in this way, solenoid 12 is normally actuated, and unlatching of latch device 10 requires that solenoid 12 be deenergized to allow the spring to shift latch member 11 to the unlatched position. As used herein, the term "actuation" with respect to a powered actuator such as solenoid 12 refers to both energizing and deenergizing of the powered actuator to shift latch member 11 to the unlatched position.

If the main power supply 15 is interrupted, backup power supply 60 provides sufficient power to actuate solenoid 12 to unlatch the powered latch 10. If the main power supply 15 is interrupted, a user can still unlatch the door by pushing the release member 20 twice, provided the vehicle is in Park.

Figure 4:
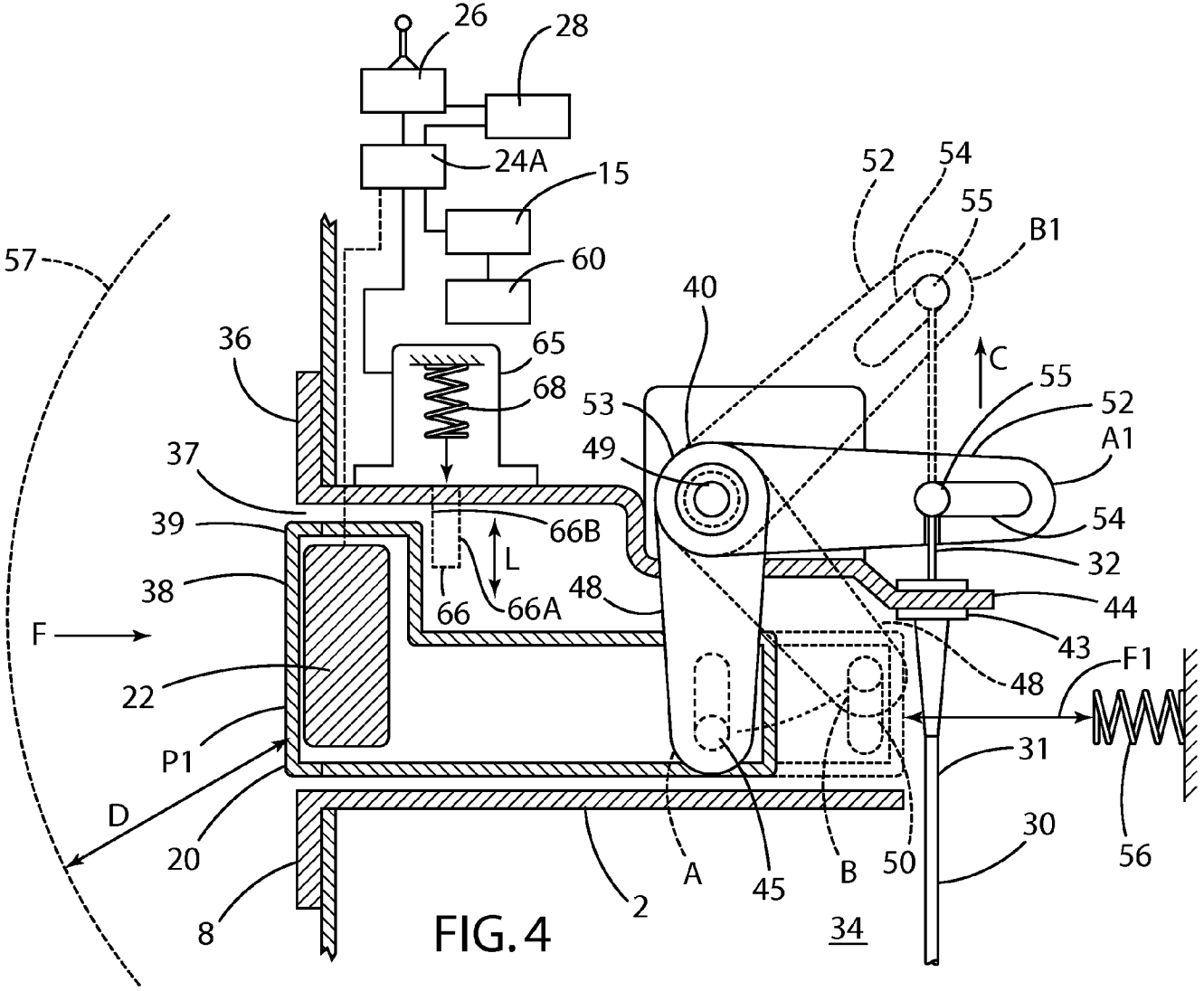
FIG. 4 is a partially fragmentary cross-sectional view of a portion of the door according to another aspect of the present invention.

With further reference to FIG. 4, a second version of the release device further includes a solenoid 65 that is utilized to prevent movement of release member 20 under specified operating conditions. Also, as discussed below, controller 24A utilizes different control logic than the device of FIG. 3. Solenoid 65 includes a movable lock member 66 that shifts in the direction of the arrow "L" between an actuated or extended position 66A and a retracted position 66B. When lock member 66 is in position 66A, lock member 66 prevents movement of release member 20 inwardly. However, when lock member 66 is retracted to the position 66B, release member 20 can be shifted inwardly in substantially the same manner as discussed above in connection with the device of FIG. 3. In the device of FIG. 4, if main power supply 15 is operating normally, controller 24A is programmed such that lock member 66 of solenoid 65 is in position 66A, thereby preventing inward movement of release member 20 if main power supply 15 is operating normally. Controller 24A may also be configured to ensure that lock member 66 is in the extended position 66A if gear shift selector 26 and transmission 28 are not in Park and/or if the vehicle speed is not below a predefined maximum speed (the predefined maximum speed may be zero). However, if main power supply 15 is interrupted spring 68 in solenoid 65 causes solenoid 65 to retract lock member 66 to retracted position 66B, thereby allowing an operator to shift release member 20 inwardly twice to release powered latch device 10. A spring 68 biases lock member 66 into the retracted position 66A, such that power must be supplied to solenoid 65 to extend lock member 66 to the extended position 66B.

Thus, in the arrangement of FIG. 4, under normal vehicle power conditions the mechanical lock-out 66 blocks the movement of release member 20, such that an operator cannot shift release member 20 while vehicle power is normal to prevent mechanical release of powered latch device 10. However, controller 24A is configured such that detection of an object within predetermined distance D within a predefined time interval causes powered latch device 10 to unlatch if power supply 15 is operating normally and the vehicle is in the Parked condition. Thus, mechanical release 20 can be utilized only if power supply 15 is interrupted, whereas the sensor 22 will cause release of powered latch device 10 if the vehicle power supply 15 is normal and the vehicle is in the Parked position. However, if the power supply 15 is operating normally and the vehicle is not in Park, sensor 22 cannot cause unlatching of powered latch device 10 due to the predefined conditions programmed into controller 24A.

Figure 5:
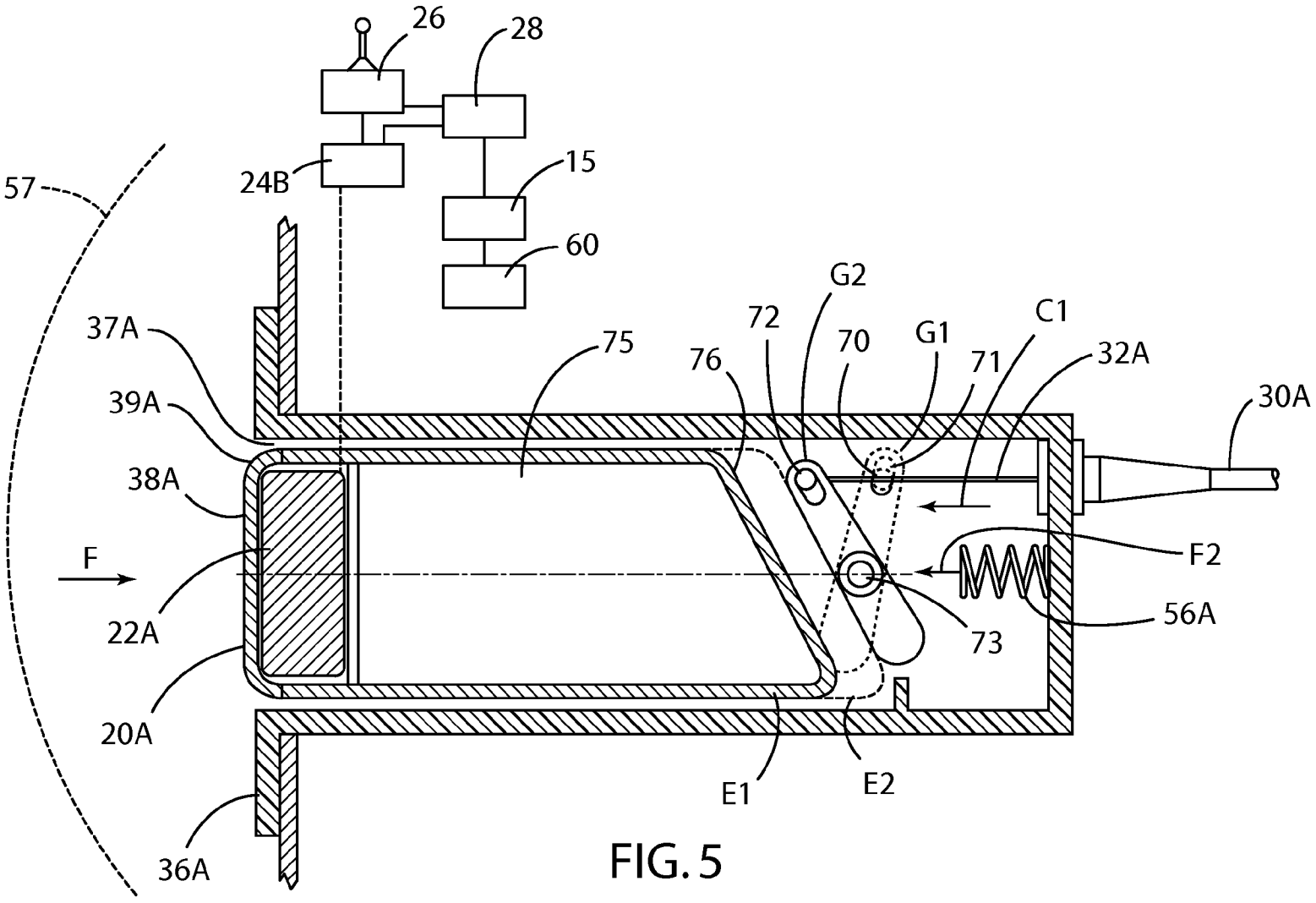
FIG. 5 is a partially fragmentary cross-sectional view of a portion of the door according to another aspect of the present invention.

With further reference to FIG. 5, a latch device according to another aspect of the present invention includes a movable member 20A that is movably disposed within a housing 36A. Release member 20A includes an extension 75 having an angled surface 76 that engages a lever 71 to rotate the lever 71 from a first position "G1" to a second position "G2." Arm 70 is rotatably mounted to a pivot member 73, and rotation of arm 70 from position G1 to position G2 generates a force shifting inner cable 32A in the direction of the arrow "C1." Thus, the device of FIG. 5 causes movement of inner cable member 32 in a manner that is similar to the device of FIG. 3. A spring 56A generates a force "F2" tending to bias release member 20A outwardly against a force F applied by an operator. Controller 24B may be configured in substantially the same manner as the devices of FIGS. 3 and 4. Also, it will be understood that a locking solenoid 65 (FIG. 4) may be utilized to prevent movement of release member 20A of the device of FIG. 5, and controller 24 may be configured in substantially the same manner as described above in connection with the device of FIG. 4.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door assembly including a powered latch release device, the door assembly comprising:

a vehicle door having inner and outer opposite sides and a first side edge portion configured to be movably mounted to a vehicle, and a second side edge portion extending along an opposite edge of the vehicle door, the inner side of the vehicle door defining an interior surface having an opening therein;

an electrical power supply;

a latch having a movable latch member and an electrically powered actuator that is configured to shift the movable latch member from a retaining position to a released position;

a release member movably mounted in the opening on the interior surface of the vehicle door for movement from a rest position to an actuated position;

a mechanical member operably interconnecting the release member to the movable latch member such that movement of the release member causes the movable latch member to move from the retaining position to the released position without actuating the electrically powered actuator;

a powered lock including a solenoid that is operably connected to the electrical power supply, and a lock member that is connected to the solenoid and shifts between extended and retracted positions, the powered lock including a spring biasing the lock member to the retracted position, and wherein the solenoid retains the lock member in the extended position when the solenoid is actuated, wherein the lock member prevents movement of the release member from the rest position to the actuated position when the lock member is in the extended position, and permits movement of the release member from the rest position to the actuated position when the lock member is in the retracted position, such that the solenoid is deactivated if the electrical power supply fails, thereby shifting the lock member to the retracted position and permitting movement of the release member to move the movable latch member from the retaining position to the released position; and a proximity sensor positioned adjacent the release member, wherein the proximity sensor is configured to detect an object moved to within a predefined vicinity of the sensor:

the electrically powered actuator moves the latch member from the retaining position to the released position if the sensor detects an object.

2. The vehicle door assembly of claim 1, wherein:

the electrically powered actuator is adapted to be operably connected to a vehicle speed sensor; and the latch release device only releases the latch member if a vehicle velocity determined by a vehicle speed sensor is below a predefined maximum allowable speed.

3. The vehicle door assembly of claim 2, wherein:

the maximum allowable speed is zero.

4. The vehicle door assembly of claim 1, wherein:

the release member is biased towards the rest position.

5. The vehicle door assembly of claim 4, wherein:

the release member only causes the movable latch member to move from the latched position to the unlatched position if the release member is moved from the rest position to the actuated position twice.

* * * * *